US010815022B2

(12) United States Patent
Cline et al.

(10) Patent No.: US 10,815,022 B2
(45) Date of Patent: Oct. 27, 2020

(54) RETAIL READY PACKAGE FOR CARDED PRODUCTS

(71) Applicant: WestRock Shared Services, LLC, Atlanta, GA (US)

(72) Inventors: Pinocchio Z. Cline, Conyers, GA (US); Kenneth C. Smith, Marietta, GA (US)

(73) Assignee: WestRock Shared Services, LLC, Atlanta, GA (US)

( * ) Notice: Subject to any disclaimer, the term of this patent is extended or adjusted under 35 U.S.C. 154(b) by 30 days.

(21) Appl. No.: 16/221,878

(22) Filed: Dec. 17, 2018

(65) Prior Publication Data

US 2020/0189788 A1 Jun. 18, 2020

(51) Int. Cl.

| | |
|---|---|
| ***B65D 5/20*** | (2006.01) |
| ***B65D 5/02*** | (2006.01) |
| ***B65D 5/54*** | (2006.01) |
| ***B65D 5/70*** | (2006.01) |
| ***B65D 5/42*** | (2006.01) |
| ***B65D 5/00*** | (2006.01) |

(52) U.S. Cl.

CPC ..... *B65D 5/20* (2013.01); *B65D 5/0227* (2013.01); *B65D 5/4204* (2013.01); *B65D 5/54* (2013.01); *B65D 5/701* (2013.01); *B65D 5/0095* (2013.01)

(58) Field of Classification Search

CPC ..... B65D 5/20; B65D 5/0227; B65D 5/4204; B65D 5/54; B65D 5/701; B65D 5/0095; B65D 5/5021; B65D 5/5052; B65D 5/5023; B65D 5/5445; B65D 5/6608; B65D 5/6605; B65D 5/6629; B65D 5/6632

USPC ..... 206/485, 764, 45.28, 45.29, 589, 774; 229/242, 207, 168, 200, 120.08, 120.13, 229/120.17, 120.18, 120.23, 120.33, 229/120.34

See application file for complete search history.

(56) References Cited

U.S. PATENT DOCUMENTS

| | | | | | |
|---|---|---|---|---|---|
| 3,927,761 | A * | 12/1975 | Boyle | B65D 5/18 | 206/756 |
| 4,025,039 | A * | 5/1977 | Croll | B65D 5/5014 | 206/485 |
| 4,432,491 | A * | 2/1984 | Muise | B65D 5/2052 | 206/427 |
| 4,485,922 | A * | 12/1984 | Desmond | B65D 5/5021 | 206/485 |
| 4,621,766 | A * | 11/1986 | McClure | B65D 5/28 | 229/117.17 |
| 4,832,199 | A * | 5/1989 | Rigby | B65D 5/5021 | 206/485 |
| 5,505,309 | A * | 4/1996 | Taravella | B65D 5/5021 | 206/485 |
| 5,529,187 | A * | 6/1996 | DeNola | B65D 5/5021 | 206/449 |
| 5,979,662 | A * | 11/1999 | Green | B65D 5/5021 | 206/463 |
| 6,427,842 | B1 * | 8/2002 | Green | B65D 5/5021 | 206/497 |

(Continued)

*Primary Examiner* — Chun Hoi Cheung

(74) *Attorney, Agent, or Firm* — WestRock Intellectual Property Group

(57) ABSTRACT

A retail ready cardboard package for shipping and displaying carded products is disclosed, which includes interior support struts having longitudinally extending lateral rail portions that have a plurality of longitudinally spaced apart transverse slots formed therein for accommodating and retaining the carded products.

20 Claims, 9 Drawing Sheets

(56) References Cited

U.S. PATENT DOCUMENTS

| | | | | |
|---|---|---|---|---|
| 7,624,876 | B1 * | 12/2009 | Green | B65D 75/322 206/485 |
| 8,336,713 | B2 * | 12/2012 | Poitevin | B65D 5/5445 206/485 |
| 2002/0017477 | A1 * | 2/2002 | Azam | B65D 5/2009 206/485 |
| 2002/0175106 | A1 * | 11/2002 | Nemoto | B65D 5/5021 206/526 |
| 2003/0024848 | A1 * | 2/2003 | Oycke | B65D 5/5021 206/526 |
| 2004/0163994 | A1 * | 8/2004 | Gardner | B65D 5/5445 206/736 |
| 2007/0256952 | A1 * | 11/2007 | Kim-Gifford | B65D 5/5021 206/485 |
| 2010/0288824 | A1 * | 11/2010 | Pinkstone | B65D 5/5213 229/207 |
| 2017/0267399 | A1 * | 9/2017 | Buscema | B31B 50/60 |
| 2018/0111714 | A1 * | 4/2018 | Zacherle | B65D 71/36 |
| 2019/0382158 | A1 * | 12/2019 | Bojie | B65D 5/5445 |
| 2020/0079549 | A1 * | 3/2020 | Prakken | B65B 7/20 |

* cited by examiner

RETAIL READY PACKAGE FOR CARDED PRODUCTS

BACKGROUND OF THE INVENTION

1. Field of the Invention

The subject invention is directed to product packaging, and more particularly, to a retail ready package for shipping and displaying carded products.

2. Description of Related Art

Retailers, such as big-box stores, superstores and warehouse clubs sell large quantities of fast moving consumer goods. These retailers often want to have items shipped from their distribution centers to the stores in unit loads and bulk boxes that can be stocked without handling of the merchandise.

The goal for corrugated shipping containers is to put case goods directly onto shelves and stocking locations without individually handling the unit packs or primary packages. To this end, retailers often require products to come in shelf ready packaging to reduce stocking costs and save labor expenses. Shelf-ready packaging, also known as, retail ready packaging refer to the packaging of a product so that it is delivered to a retailer in packaging optimized for efficient stocking and sale.

A problem associated with retail ready packages used to ship and display carded products, such as blister packs and frozen foods, is that the carded products tend to become displaced within their package when handled by customers. This often requires upkeep and reorganization by retailers to ensure the products are easy to view and aesthetically pleasing to customers, which can be costly and time consuming. It would be beneficial therefore, to provide a retail ready package for shipping and displaying carded products in a manner that maintains the products in spaced relationship with the package.

SUMMARY OF THE DISCLOSURE

The subject invention is directed to a new and useful retail ready package for carded products that is formed from a die cut cardboard blank. The package includes a bottom panel having opposed front and rear edges, and opposed first and second side edges. A front panel is foldably connected to the front edge of the bottom panel and it has opposed first and second side edges and a top edge. A first front interior side panel is foldably connected to the first side edge of the front panel and a second front interior side panel is foldably connected to the second side edge of the front panel.

A rear panel is foldably connected to the rear edge of the bottom panel and it has opposed first and second side edges and a top edge. A first rear interior side panel is foldably connected to the first side edge of the rear panel and a second rear interior side panel is foldably connected to the second side edge of the rear panel. A front top panel is foldably connected to the top edge of the front panel, wherein a first front exterior side panel is foldably connected to a first side edge of the front top panel, and a second front exterior side panel is foldably connected to a second side edge of the front top panel.

A rear top panel is foldably connected to the top edge of the rear panel, wherein a first rear exterior side panel is foldably connected to a first side edge of the rear top panel, and a second rear exterior side panel is foldably connected to a second side edge of the rear top panel.

The package includes a first interior support strut having a first longitudinally extending lateral rail portion. The first lateral rail portion is foldably connected to the first interior support strut along a lateral crease and also to the first side edge of bottom panel. The first lateral rail portion includes a plurality of longitudinally spaced apart transverse slots. The package also includes a second interior support strut having a second longitudinally extending lateral rail portion. The second lateral rail portion is foldably connected to the second interior support strut along a lateral crease and also to the second side edge of bottom panel. The second lateral rail portion includes a plurality of longitudinally spaced apart transverse slots.

The longitudinally spaced apart transverse slots in the first lateral rail portion are laterally aligned with the longitudinally spaced apart transverse slots in the second lateral rail portion to accommodate a plurality of carded products in spaced apart relationship. Preferably, the first interior support strut has an arcuate front edge and the second interior support strut has an arcuate front edge.

The rear panel further includes a separable rear panel portion defined by a perforated tear line and a circular aperture is formed therein for initiating a separating tear. The first interior side panel includes a separable panel portion and a remaining panel portion that are separated by a perforated tear line, wherein the tear line has an associated crescent shaped aperture for initiating a tear. The second interior side panel includes a separable panel portion and a remaining panel portion that are separated by a perforated tear line, wherein the tear line has an associated crescent shaped aperture for initiating a tear. Preferably, the front panel includes a separable panel portion that is separated from two spaced apart remaining panel portions by two perforated tear lines, wherein the separable panel portions of the front panel is integral with the separable panel portions of the of the first and second interior side panels.

The front top panel has opposed first and second side edges and a perforated handle portion. The rear top panel has opposed first and second side edges, and a perforated handle portion. The rear top panel further includes a separable portion that is integral with the separable rear panel portion. The first front exterior side panel includes a separable panel portion and a remaining panel portion that are separated from one another by a perforated tear line, wherein the tear line has an associated crescent shaped aperture for initiating a tear. The second front exterior side panel includes a separable panel portion and a remaining panel portion that are separated from one another by a perforated tear line, and wherein the tear line has an associated crescent shaped aperture for initiating a tear.

These and other features of the retail ready package of the subject invention will become more readily apparent to those having ordinary skill in the art to which the subject invention appertains from the detailed description of the preferred embodiments taken in conjunction with the following brief description of the drawings.

BRIEF DESCRIPTION OF THE DRAWINGS

So that those skilled in the art will readily understand how to make and use the retail ready package of the subject invention without undue experimentation, preferred embodiments thereof will be described in detail herein below with reference to the figures wherein.

DETAILED DESCRIPTION OF THE PREFERRED EMBODIMENTS

Figure 1:
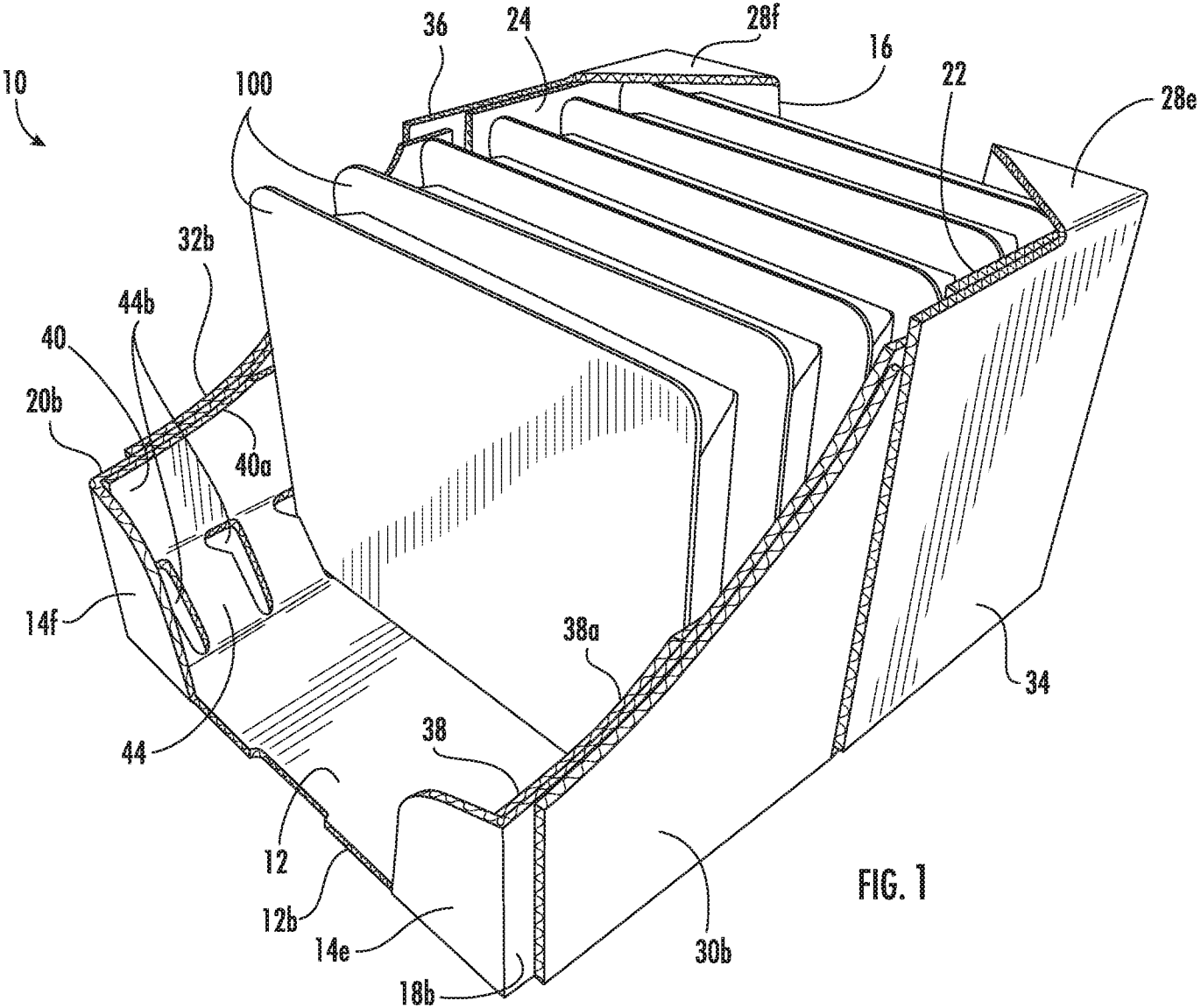
FIG. 1 is a perspective view of the retail ready package of the subject invention, with the removable portion separated therefrom along predefined perforated cut lines to reveal a plurality of carded products maintained therein in spaced apart relationship.

Referring now to the drawings wherein like reference numerals identify similar structural features or elements of the subject invention, there is illustrated in FIG. 1 a retail ready package for shipping and displaying carded products such as blister packs and frozen foods, constructed in accordance with a preferred embodiment of the subject invention and designated generally by reference numeral 10. The package 10 illustrated in FIG. 1 is shown in an open shelf ready condition, with a plurality of carded products 100 displayed in spaced apart relationship. The structure of package 10 and the die cut cardboard blank from which it is erected, will be discussed in greater detail below.

Figure 2:
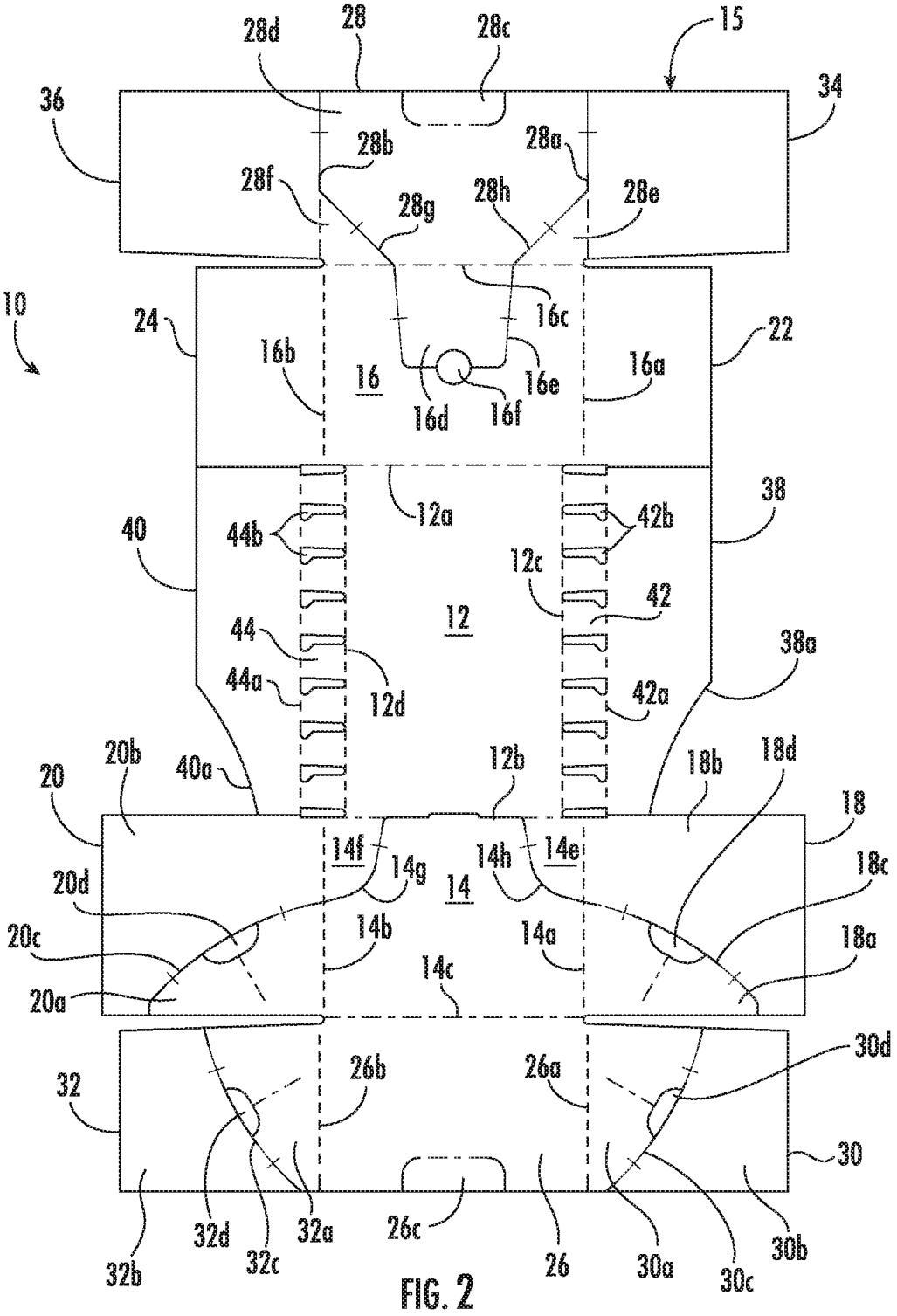
FIG. 2 is a top plan view of a die cut blank used to form the retail ready package of the subject invention.

Referring now to FIG. 2, the die cut cardboard blank 15 from which the retail ready package 10 of the subject invention is erected includes a bottom panel 12 having opposed rear and front edges 12*a* and 12*b*, and opposed first and second side edges 12*c* and 12*d*. A front panel 14 that is foldably attached to the front edge 12*b* of bottom panel 12, and it has opposed first and second side edges 14*a* and 14*b*, and a top edge 14*c*. The majority of the front panel 14 is separable from the two spaced apart front corner portions 14*e* and 14*f* of front panel 14 along respective curved score lines 14*g* and 14*h*.

A rear panel 16 that is foldably attached to the rear edge 12*a* of bottom panel 12 and it has opposed first and second side edges 16*a* and 16*b*, and a top edge 16*c*. The rear panel 16 further includes a generally U-shaped separable rear panel portion 16*d* formed by a perforated tear line 16*e*. A circular aperture 16*f* is included in tear line 16*e* for initiating a separating tear.

The blank 15 further includes a first front interior side panel 18 that is foldably attached to the first side edge 14*a* of front panel 14. The first interior side panel 18 includes a separable panel portion 18*a* and a remaining panel portion 18*b* separated by a curved perforated tear line 18*c*, which has an associated crescent shaped aperture 18*d* for initiating a tear. The blank 15 also includes a second front interior side panel 20 that is foldably attached to the second side edge 14*b* of front panel 14. The second interior side panel 20 includes a separable panel portion 20*a* and a remaining panel portion 20*b* separated by a curved perforated tear line 20*c*, which has an associated crescent shaped aperture 20*d* for initiating a tear.

The blank 15 further includes a first rear interior side panel 22 that is foldably connected to the first side edge 16*a* of rear panel 16 and a second rear interior side panel 24 that is foldably connected to the second side edge 16*b* of rear panel 16. The blank 15 also has a front top panel 26 that is foldably connected to the top edge 14*c* of front panel 14. The front top panel 26 has opposed first and second side edges 26*a* and 26*b*, and a perforated handle portion 26*c*.

The blank 15 further includes a rear top panel 28 that is foldably connected to the top edge 16*c* of front panel 16. The rear top panel 28 has opposed first and second side edges 28*a* and 28*b*, and a 28*c* perforated handle portion. The rear top panel 28 also includes a separable portion 28*d* that is integral with the separable rear panel portion 16*d* of rear panel 16. The separable panel portion 28*d* is defined by two oppositely angled perforated tear lines 28*g* and 28*h* that communicate with the U-shaped tear line 16*e* of rear panel 16. The angled tear lines 28*g* and 28*h* delineate the remaining triangular portions 28*f* and 28*e* of the rear top panel 28.

The blank 15 further includes a first front exterior side panel 30 that is foldably connected to the front top panel 26 along the first side edge 26*a*. The first front exterior side panel 30 includes a separable panel portion 30*a* and a remaining panel portion 30*b*, which are separated from one another by an arcuate perforated tear line 30*c*, which has an associated crescent shaped aperture 30*d* for initiating a tear.

The blank 15 also includes a second front exterior side panel 32 that is foldably connected to the front top panel 26 along the second side edge 26*b*. The second front exterior side panel 32 includes a separable panel portion 32*a* and a remaining panel portion 32*b*, which are separated from one another by an arcuate perforated tear line 32*c*, which has an associated crescent shaped aperture 32*d* for initiating a tear.

The blank 15 further includes a first rear exterior side panel 34 that is foldably connected to the first side edge 28*a* of rear top panel 28 and a second rear exterior side panel 36 that is foldably connected to the second side edge 28*b* of rear top panel 28.

The blank 15 also has a first interior support strut 38 that has an arcuate front edge 38*a* and a first longitudinally extending lateral rail portion 42. The first lateral rail portion 42 is foldably connected to the first interior support strut 38 along a lateral crease 42*a* and also to the first side edge 12*c* of bottom panel 12. The first lateral rail portion 42 includes a plurality of longitudinally spaced apart transverse slots 42*b* for accommodating a carded product.

The blank 15 further includes a second interior support strut 40 that has an arcuate front edge 40*a* and a second longitudinally extending lateral rail portion 44. The second lateral rail portion 44 is foldably connected to the second interior support strut 40 along a lateral crease 44*a* and also to the second side edge 12*d* of bottom panel 12. The second lateral rail portion 44 includes a plurality of longitudinally spaced apart transverse slots 44*b* for accommodating a carded product.

Figure 3:
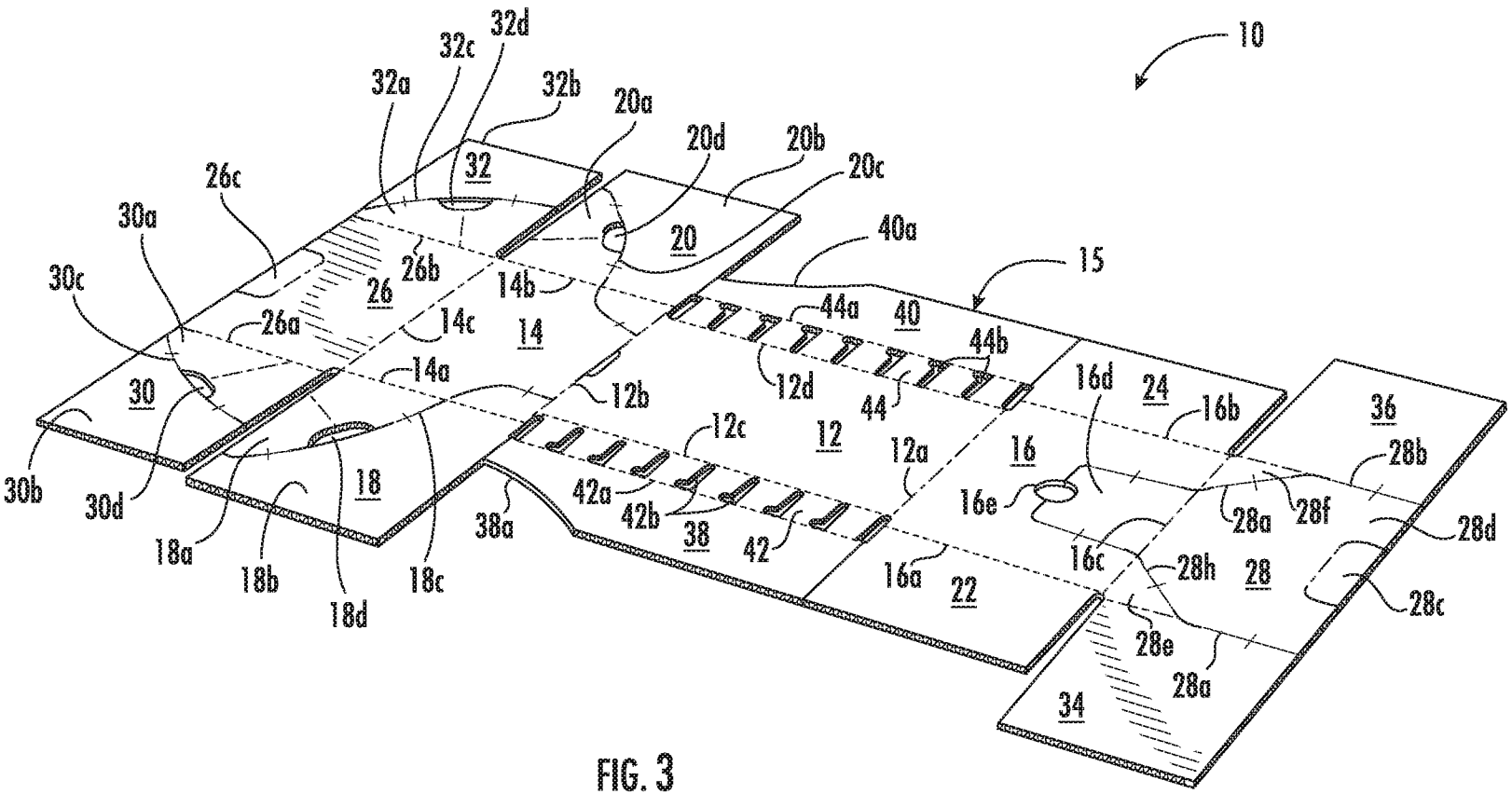
FIG. 3 is a perspective view of the blank shown in FIG. 3.
Figure 4:
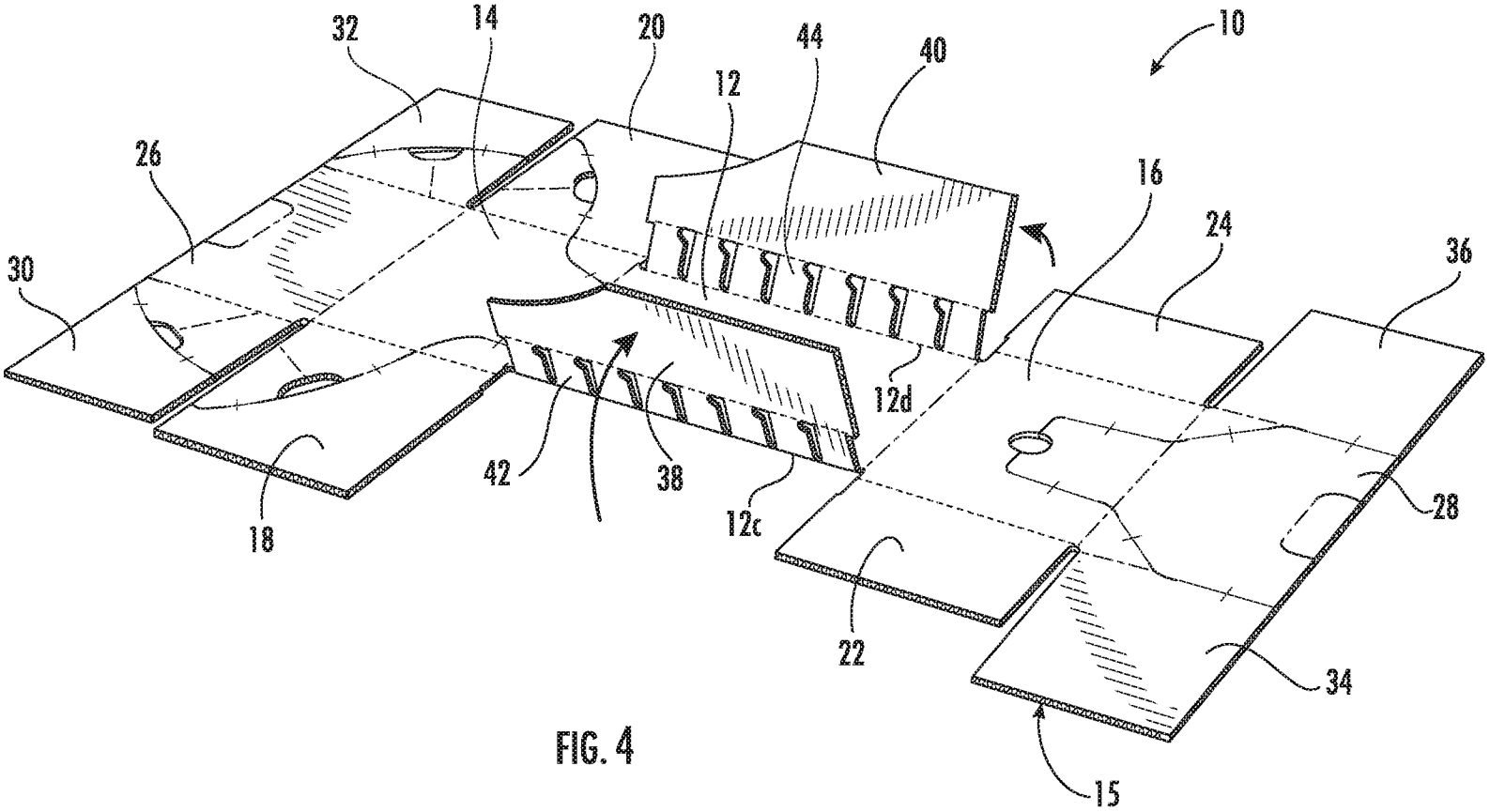
FIG. 4 illustrates the lateral support struts folded upwardly into an erect position along lateral fold lines.
Figure 5:
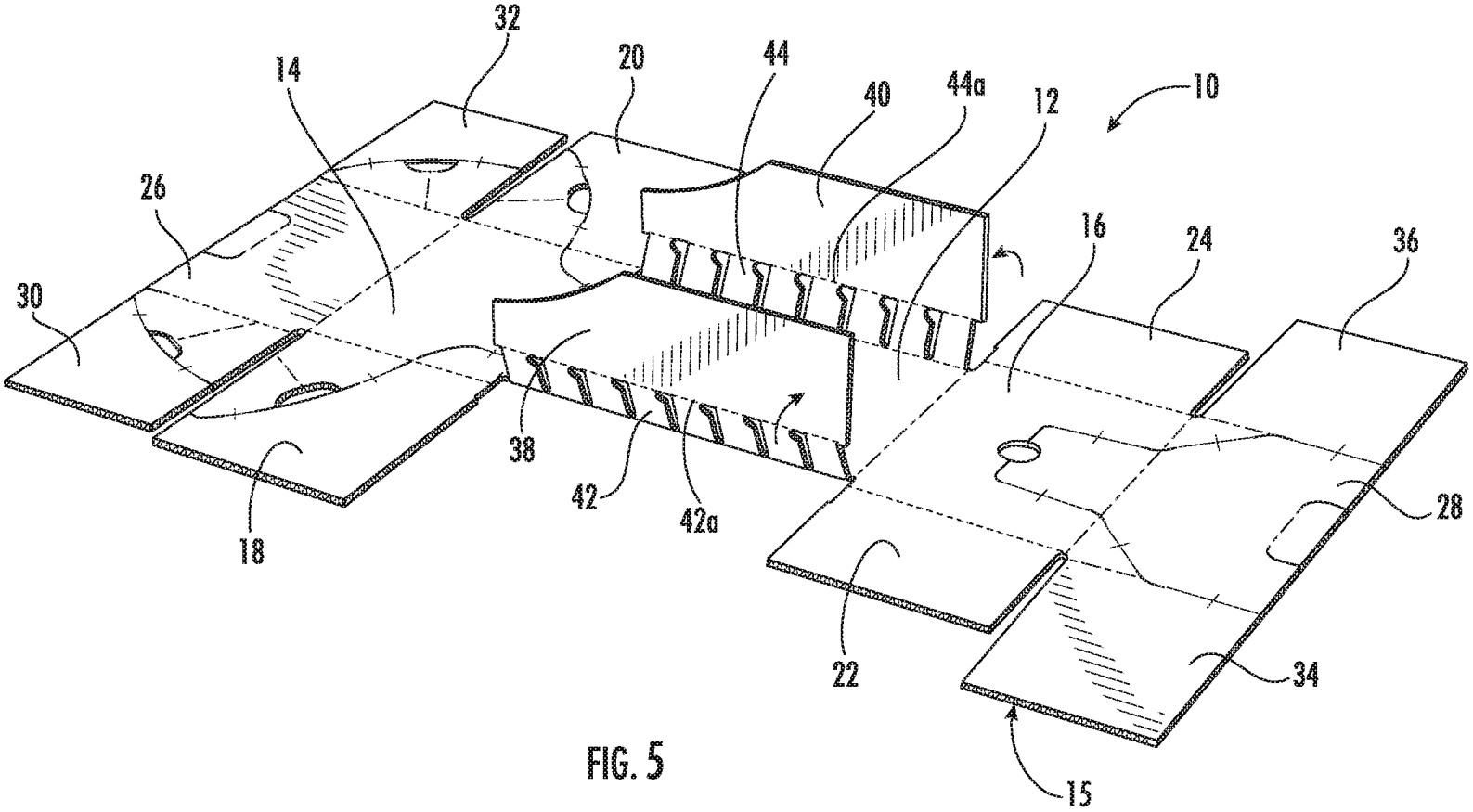
FIG. 5 illustrates the lateral support struts folded inwardly relative to the lateral rail portions associated therewith along lateral creases.

Turning now to FIGS. 3 through 9, there is illustrated the operative steps for erecting (and packing) the retail ready package 10 of the subject invention from the die cut blank 15, which his shown in FIG. 3 in a perspective view. Initially, the lateral support struts 38 and 40 are folded upwardly into an erect position along opposed first and second side edges 12*c* and 12*d* of bottom panel 12, as illustrated in FIG. 4. Then, as shown in FIG. 5, the lateral support struts 38 and 40 folded inwardly relative to the lateral rail portions 42 and 44 respectively associated therewith along respective lateral creases 42*a* and 44*a*.

Figure 6:
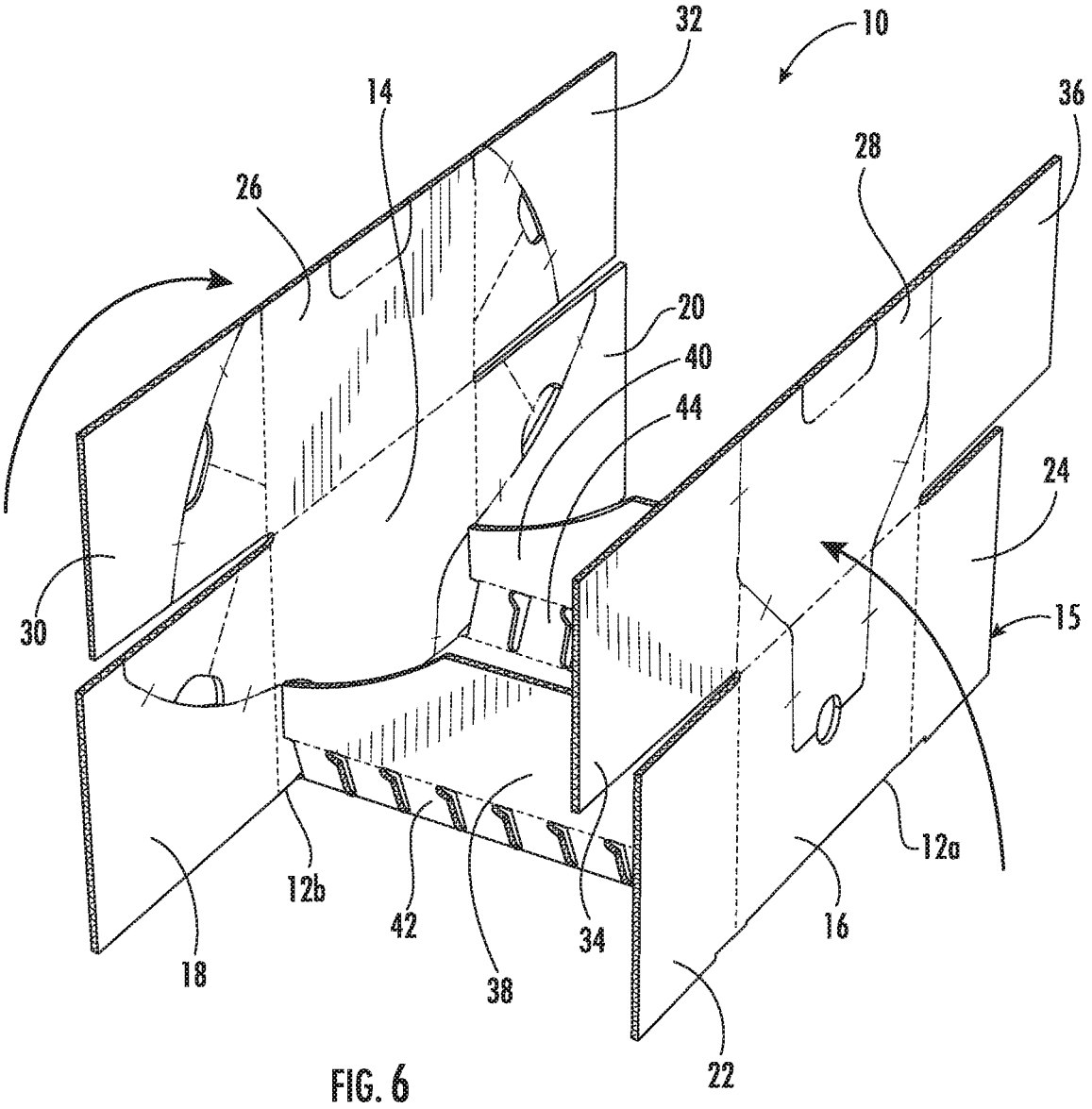
FIG. 6 illustrates the front and rear panels folded into an erect position.
Figure 7:
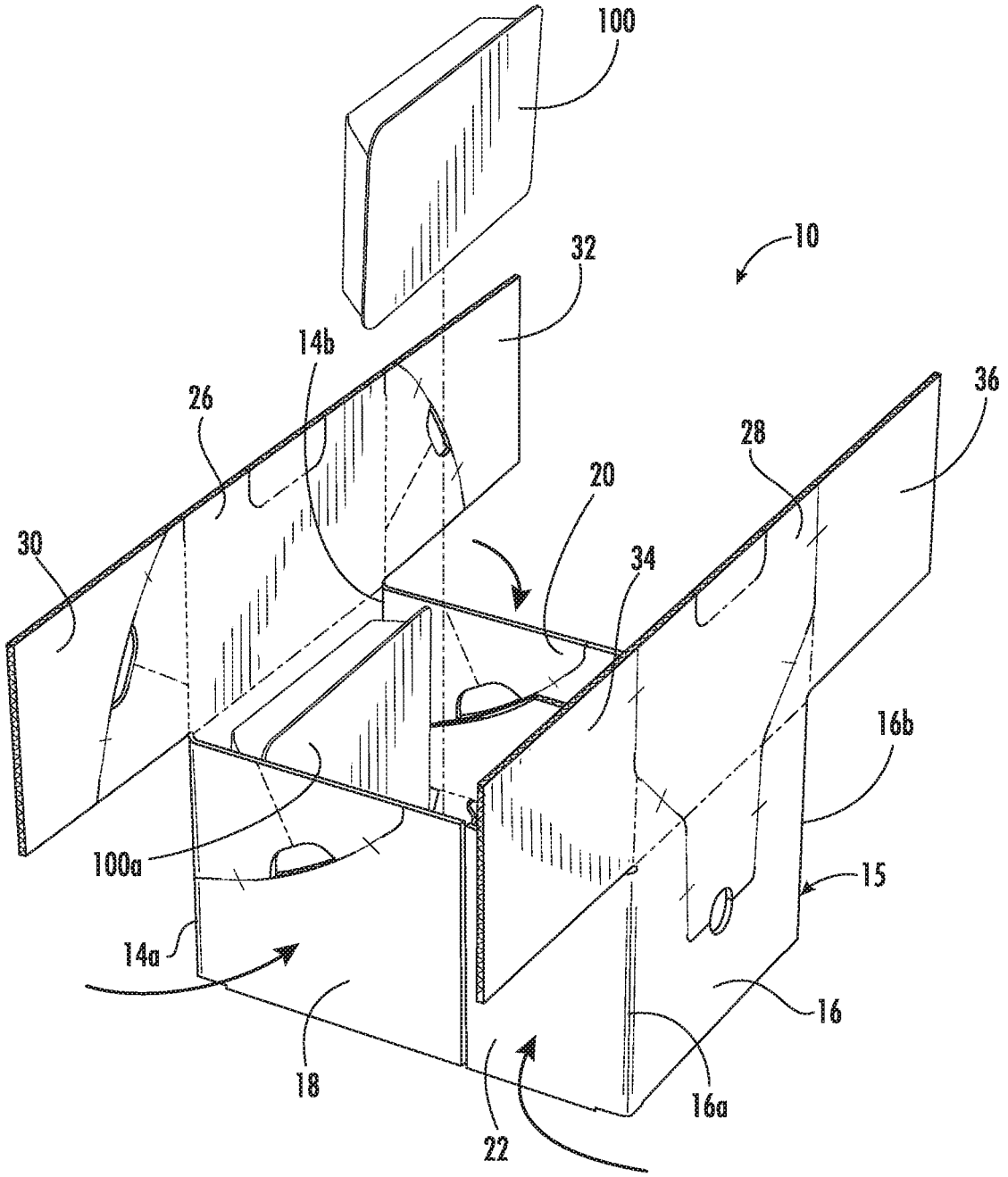
FIG. 7 illustrates the front and rear interior side panels folded into an erect position, and the insertion of carded products into the interior of the retail ready package.

Next, the front and rear panels 14 and 16 are folded into an erect position along the front and rear edges 12*a* and 12*b* of bottom panel 12, as shown in FIG. 6. Thereafter, as shown in FIG. 7, the front and rear interior side panels 18 and 20 are folded into an erected position and glued into place using an adhesive. Thereupon, a plurality of carded products 100 can be inserted into the interior of the partially constructed package 10 in spaced apart relationship, as shown in FIG. 7.

Figure 8:
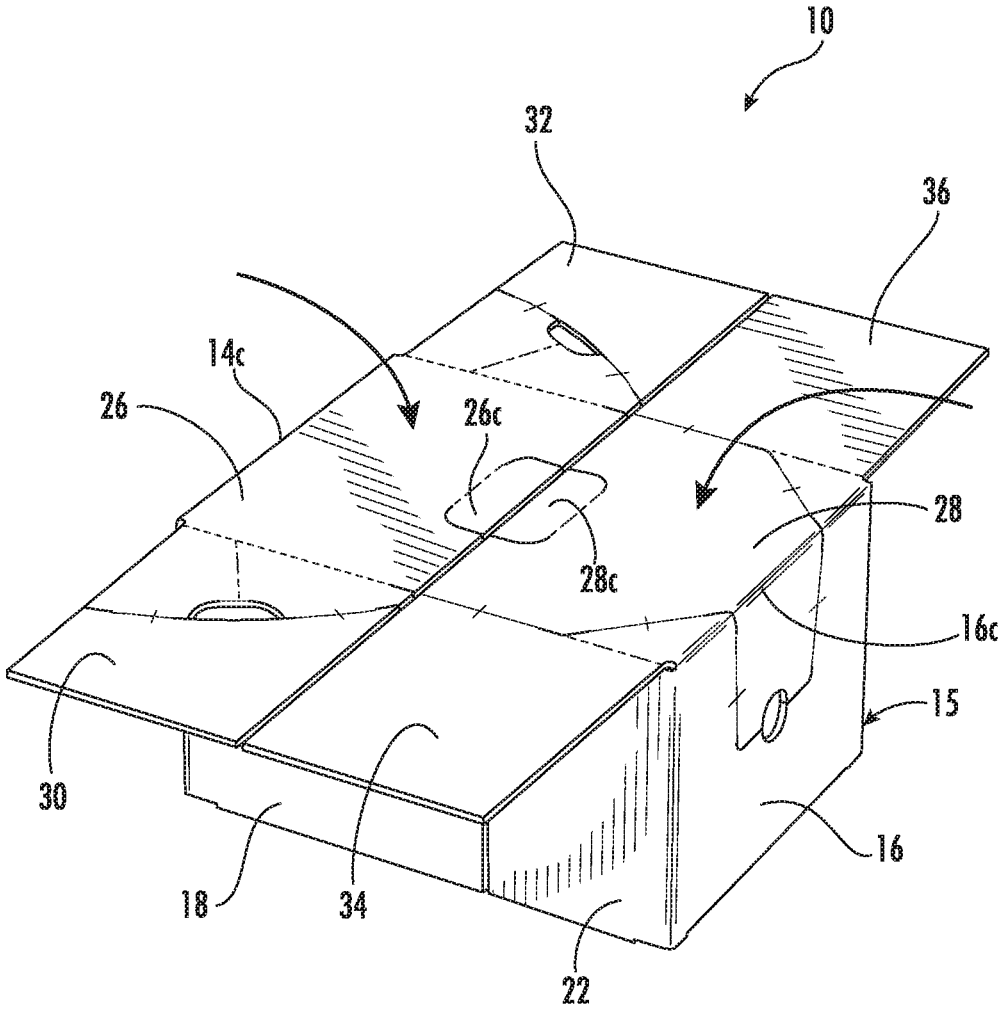
FIG. 8 illustrates the front and rear top panels folded into an erected position.

Then, as shown in FIG. 8, the front and rear top panels 26 and 28 are folded into an erected position, and finally, the front exterior side panels 30 and 32, and the rear exterior side panels 34 and 36, are folded into an erected position and glued into place using an adhesive. Here, the front interior side panel 18 and the front exterior side panel 30 are both broken away to show several carded products 100 supported in spaced relationship within the transverse slots 42*b* in the lateral side rail 42 of the lateral support strut 38.

Figure 9:
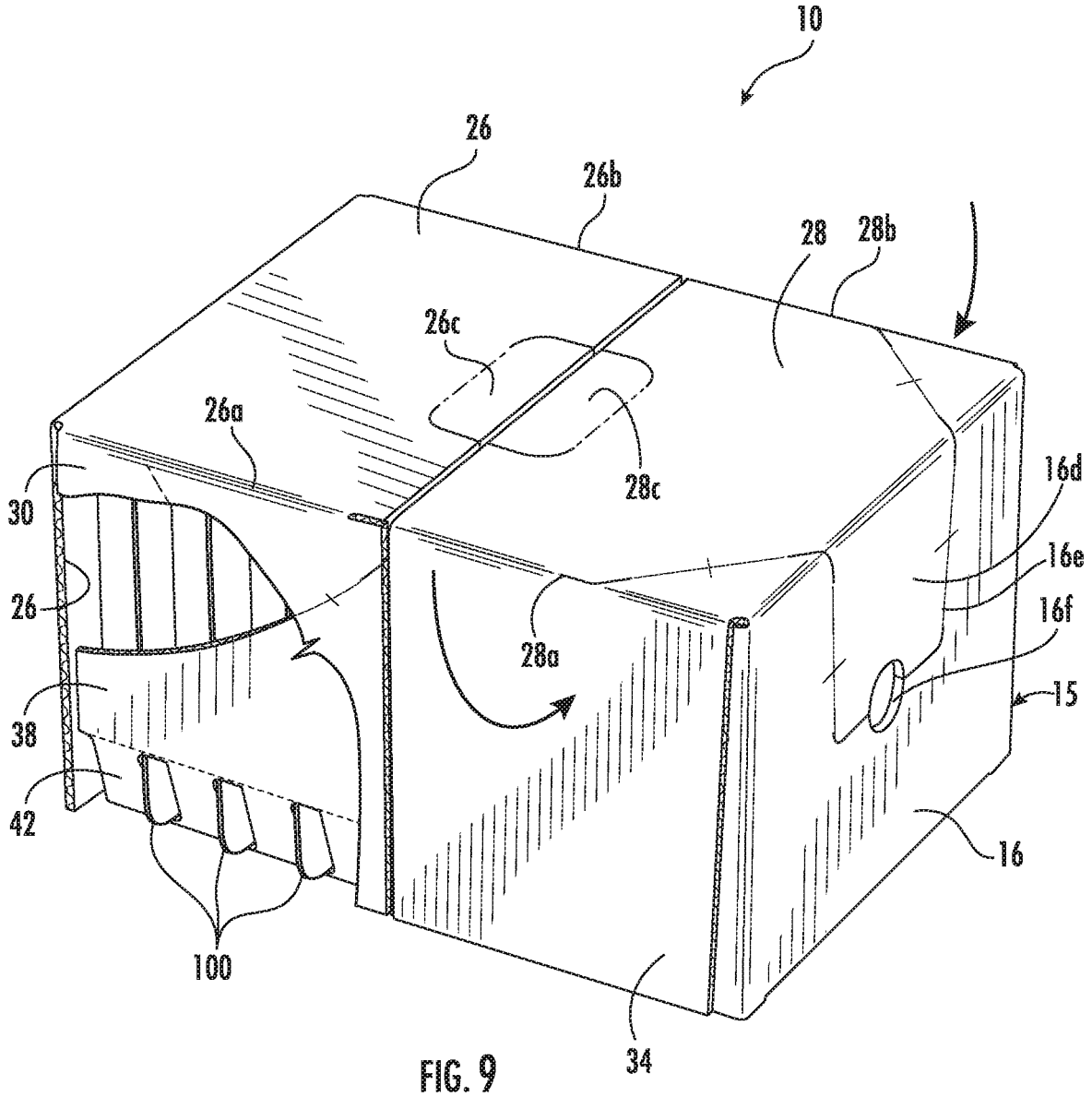
FIG. 9 illustrates front and rear exterior side panels folded into an erect position, wherein the front interior and exterior side panel are broken away to show carded products supported in the transverse slots in the lateral side rail of the lateral support strut.

In use, the retail ready package 10 of the subject invention can be converted from the shipping condition shown in FIG. 9 to the shelf ready display condition shown in FIG. 1 by a manual process that involves separating the separable panel portion 16*d* from rear panel 16 along with the integral separable panel portion 28*d* of rear top panel 28. This is done by tearing along the U-shaped tear line 16*e* and the two oppositely angled perforated tear lines 28*g* and 28*h*, starting at aperture 16*f*. As a result, the corner portions 28*e* and 28*f* of panel 28 remain, foldably attached to panels 34 and 36, respectively.

The process also includes separating the separable panel portion 18*a* of panel 18 from the remaining panel portion 18*b* of panel 18 along the curved perforated tear line 18*c*, starting at crescent shaped opening 18*d*, and separating the separable panel portion 20*a* of panel 20 from remaining panel portion 20*b* of panel portion 20 along the curved perforated tear line 20*c*, starting at crescent shaped opening 20*d*.

In addition, the process includes separating the separable panel portion 30*b* of panel 30 from the remaining panel portion 30*a* of panel 30 along the arcuate perforated tear line 30*c*, starting at crescent shaped opening 30*d*, and separating the separable panel portion 32*b* of panel 32 from the remaining panel portion 32*a* of panel 32 along arcuate perforated tear line 32*c*, starting at crescent shaped opening 32*d*. Thereupon, the entire top panel 26 and the separable portion of the front panel 14 will be removed as well, so that the spaced apart lower corner sections 14*f* and 14*e* of panel 14, and the exterior side front panel portions 30*b* and 32*b* of panels 30 and 32, and interior side front panel portions 18*b* and 20*b* of panels 18 and 20 will remain, as shown in FIG. 1, with all of the curved upper edges on of these panels aligning in an aesthetically pleasing manner.

While the subject disclosure has been shown and described with reference to preferred embodiments, those skilled in the art will readily appreciate that changes or modifications may be made thereto without departing from the spirit or scope of the subject disclosure.

What is claimed is:

1. A die cut cardboard blank for constructing a retail ready package comprising:

a) a bottom panel having opposed front and rear edges, and opposed first and second side edges;

b) a front panel foldably connected to the front edge of the bottom panel and having opposed first and second side edges and a top edge, wherein a first front interior side panel is foldably connected to the first side edge of the front panel and a second front interior side panel is foldably connected to the second side edge of the front panel;

c) a rear panel foldably connected to the rear edge of the bottom panel and having opposed first and second side edges and a top edge, wherein a first rear interior side panel is foldably connected to the first side edge of the rear panel and a second rear interior side panel is foldably connected to the second side edge of the rear panel;

d) a front top panel foldably connected to the top edge of the front panel, wherein a first front exterior side panel is foldably connected to a first side edge of the front top panel, and a second front exterior side panel is foldably connected to a second side edge of the front top panel;

e) a rear top panel foldably connected to the top edge of the rear panel, wherein a first rear exterior side panel is foldably connected to a first side edge of the rear top panel, and a second rear exterior side panel is foldably connected to a second side edge of the rear top panel;

f) a first interior support strut having a first longitudinally extending lateral rail portion, the first lateral rail portion being foldably connected to the first interior support strut along a lateral crease and also to the first side edge of bottom panel, the first lateral rail portion including a plurality of longitudinally spaced apart transverse slots;

g) a second interior support strut having a second longitudinally extending lateral rail portion, the second lateral rail portion being foldably connected to the second interior support strut along a lateral crease and also to the second side edge of bottom panel, the second lateral rail portion including a plurality of longitudinally spaced apart transverse slots, wherein the longitudinally spaced apart transverse slots in the first lateral rail portion are laterally aligned with the longitudinally spaced apart transverse slots in the second lateral rail portion to accommodate a plurality of carded products in spaced apart relationship; and h) at least one separable portion defined by a perforated tear line, wherein a set-up package formed from the blank is configured to be transitioned from a shipping configuration to a retail-ready open configuration via separation of the at least one separable portion from a remaining portion of the set-up package.

2. A die cut cardboard blank as recited in claim 1, wherein the first interior support strut has an arcuate front edge and the second interior support strut has an arcuate front edge.

3. A die cut cardboard blank as recited in claim 1, wherein the rear panel further includes a separable rear panel portion defined by a perforated tear line and a circular aperture is formed therein for initiating a separating tear.

4. A die cut cardboard blank as recited in claim 1, wherein the first front interior side panel includes a separable panel portion and a remaining panel portion that are separated by a perforated tear line, and wherein the tear line has an associated crescent shaped aperture for initiating a tear.

5. A die cut cardboard blank as recited in claim 4, wherein the second front interior side panel includes a separable panel portion and a remaining panel portion that are separated by a perforated tear line, and wherein the tear line has an associated crescent shaped aperture for initiating a tear.

6. A die cut cardboard blank as recited in claim 5, wherein the front panel includes a separable panel portion that is separated from two spaced apart remaining panel portions by two perforated tear lines, wherein the separable panel portions of the front panel is integral with the separable panel portions of the of the first and second interior side panels.

7. A die cut cardboard blank as recited in claim 1, wherein the front top panel has opposed first and second side edges and a perforated handle portion.

8. A die cut cardboard blank as recited in claim 3, wherein the rear top panel has opposed first and second side edges, and a perforated handle portion, the rear top panel further including a separable portion that is integral with the separable rear panel portion.

9. A die cut cardboard blank as recited in claim 1, wherein the first front exterior side panel includes a separable panel portion and a remaining panel portion that are separated from one another by a perforated tear line, and wherein the tear line has an associated crescent shaped aperture for initiating a tear.

10. A die cut cardboard blank as recited in claim 9, wherein the second front exterior side panel includes a separable panel portion and a remaining panel portion that are separated from one another by a perforated tear line, and wherein the tear line has an associated crescent shaped aperture for initiating a tear.

11. A retail ready package formed from a cardboard blank comprising:

a) a bottom panel having opposed front and rear edges, and opposed first and second side edges;

b) a front panel foldably connected to the front edge of the bottom panel and having opposed first and second side edges and a top edge, wherein a first front interior side panel is foldably connected to the first side edge of the front panel and a second front interior side panel is foldably connected to the second side edge of the front panel;

c) a rear panel foldably connected to the rear edge of the bottom panel and having opposed first and second side edges and a top edge, wherein a first rear interior side panel is foldably connected to the first side edge of the rear panel and a second rear interior side panel is foldably connected to the second side edge of the rear panel;

d) a front top panel foldably connected to the top edge of the front panel, wherein a first front exterior side panel is foldably connected to a first side edge of the front top panel, and a second front exterior side panel is foldably connected to a second side edge of the front top panel;

e) a rear top panel foldably connected to the top edge of the rear panel, wherein a first rear exterior side panel is foldably connected to a first side edge of the rear top panel, and a second rear exterior side panel is foldably connected to a second side edge of the rear top panel;

f) a first interior support strut having a first longitudinally extending lateral rail portion, the first lateral rail portion being foldably connected to the first interior support strut along a lateral crease and also to the first side edge of bottom panel, the first lateral rail portion including a plurality of longitudinally spaced apart transverse slots;

g) a second interior support strut having a second longitudinally extending lateral rail portion, the second lateral rail portion being foldably connected to the second interior support strut along a lateral crease and also to the second side edge of bottom panel, the second lateral rail portion including a plurality of longitudinally spaced apart transverse slots, wherein the longitudinally spaced apart transverse slots in the first lateral rail portion are laterally aligned with the longitudinally spaced apart transverse slots in the second lateral rail portion to accommodate a plurality of carded products in spaced apart relationship; and h) at least one separable portion defined by a perforated tear line, wherein the package is configured to be transitioned from a shipping configuration to a retail-ready open configuration via separation of the at least one separable portion from a remaining portion of the package.

12. A retail ready package as recited in claim 11, wherein the first interior support strut has an arcuate front edge and the second interior support strut has an arcuate front edge.

13. A retail ready package as recited in claim 11, wherein the rear panel further includes a separable rear panel portion defined by a perforated tear line and a circular aperture is formed therein for initiating a separating tear.

14. A retail ready package as recited in claim 11, wherein the first interior side panel includes a separable panel portion and a remaining panel portion that are separated by a perforated tear line, and wherein the tear line has an associated crescent shaped aperture for initiating a tear.

15. A retail ready package as recited in claim 14, wherein the second interior side panel includes a separable panel portion and a remaining panel portion that are separated by a perforated tear line, and wherein the tear line has an associated crescent shaped aperture for initiating a tear.

16. A retail ready package as recited in claim 15, wherein the front panel includes a separable panel portion that is separated from two spaced apart remaining panel portions by two perforated tear lines, wherein the separable panel portions of the front panel is integral with the separable panel portions of the of the first and second interior side panels.

17. A retail ready package as recited in claim 11, wherein the front top panel has opposed first and second side edges and a perforated handle portion.

18. A retail ready package as recited in claim 13, wherein the rear top panel has opposed first and second side edges, and a perforated handle portion, the rear top panel further including a separable portion that is integral with the separable rear panel portion.

19. A retail ready package as recited in claim 11, wherein the first front exterior side panel includes a separable panel portion and a remaining panel portion that are separated from one another by a perforated tear line, and wherein the tear line has an associated crescent shaped aperture for initiating a tear.

20. A retail ready package as recited in claim 19, wherein the second front exterior side panel includes a separable panel portion and a remaining panel portion that are separated from one another by a perforated tear line, and wherein the tear line has an associated crescent shaped aperture for initiating a tear.

* * * * *